US008171939B2

(12) United States Patent
Bao

(10) Patent No.: US 8,171,939 B2
(45) Date of Patent: May 8, 2012

(54) CIGARETTE INJECTOR

(76) Inventor: Fan Bao, City of Industry, CA (US)

( * ) Notice: Subject to any disclaimer, the term of this patent is extended or adjusted under 35 U.S.C. 154(b) by 791 days.

(21) Appl. No.: 12/291,857

(22) Filed: Nov. 14, 2008

(65) Prior Publication Data

US 2010/0122707 A1 May 20, 2010

(51) Int. Cl.
*A24C 5/00* (2006.01)

(52) U.S. Cl. ..... 131/70; 131/75; 206/249

(58) Field of Classification Search ..... 131/70, 131/75; 206/249

See application file for complete search history.

(56) References Cited

U.S. PATENT DOCUMENTS 1,476,652 A * 12/1923 Shore ..... 131/73
4,572,216 A * 2/1986 Josuttis et al. ..... 131/70
7,905,235 B2 * 3/2011 Patel ..... 131/57

* cited by examiner

*Primary Examiner* — Richard Crispino

*Assistant Examiner* — Dionne Walls Mayes

(74) *Attorney, Agent, or Firm* — Raymond Y. Chan; David and Raymond Patent Firm

(57) ABSTRACT

A cigarette injector for loading tobacco leaves into a hollow cigarette paper tube includes a housing having a tobacco cavity for the tobacco leaves disposing, an electric motor having an output shaft and a cigarette filling arrangement. The cigarette filling arrangement includes an elongated injection tube having a supplying end communicating with the tobacco cavity and a dispensing end for the cigarette paper tube encircling therewith, and an elongated tobacco feeder, which has a helicoid shape, having a driving end being driven to rotate via the output shaft of the electric motor and a feeding end extended within the injection tube through the tobacco cavity, wherein the tobacco feeder is driven to rotate for loading the tobacco leaves within the tobacco cavity into the cigarette paper tube through the injection tube.

11 Claims, 6 Drawing Sheets

CIGARETTE INJECTOR

BACKGROUND OF THE PRESENT INVENTION

1. Field of Invention

The present invention relates to a cigarette injector, and more particularly to a cigarette injector which injects tobaccos into paper tube without breaking the tobaccos.

2. Description of Related Arts

The cigarettes consumed by people are normally manufactured by factories and are sold in market. A cigarette is a paper wrapped tube stuffed with finely cut tobacco leaves. Generally the tobacco leaves are cured and processed with addictives. There are many tastes and brands of cigarettes people can select because of the different types of tobacco leaves, different cure processes and addictives. But still some people want to smoke their own tobaccos.

For those people using their favor loose tobaccos, they have to prepare their own cigarettes by rolling the paper to wrap their cut tobacco leaves inside. Doing this by hands takes a lot of time, and it is also difficult to stuff the tobacco leaves with a uniform and proper compactness. If the tobacco leaves are wrapped too compressed, it is difficult to smoke; if the tobacco leaves are wrapped too loose, it is easy to drop the tobacco leaves, and get the cigarette extinguished.

Currently there are machines can help people to make cigarettes using their own tobaccos. The tradition machine generally has a chamber to contain tobaccos. At one end of the chamber is a nozzle which is inserted into one end of the paper tube. At the other end of the chamber is a piston to inject the tobaccos inside the chamber into the paper tube through the nozzle. The problem for this kind of machine is the compactness of the tobaccos injected into the paper tube depends on how much tobaccos are inserted into the chamber. It still has to be controlled by hand which is not accurate and not convenient. Another kind of machine is using a screw like shaft to pushing tobaccos in the paper tube through a pipe. When the screw like shaft is rolling, the thread of the screw like shaft will drive the tobaccos along the shaft inside the pipe, and finally injected into the paper tube connected with the opening of the pipe.

The above-mentioned conventional machine is easy to use, but still has some problems. First, tobaccos are cured, they are dry and crisp. The thread of the shaft has blade at the edge, together with the inner wall of the pipe, the blade can easily shred the tobaccos into smaller pieces or even power. This will damage the quality of the tobaccos. Also, the size of the thread and the diameter of the axes of the shaft is fixed, the gap between the blade and the inner wall of the pipe is also fixed, which is not suitable for different types of tobaccos. Some tobaccos are cut in smaller pieces which are easy to leak from the gap; some are cut in long and thick slides which could be cut by the blade, or get stuck inside the pipe.

SUMMARY OF THE PRESENT INVENTION

The main object of the present invention is to provide a cigarette injector which injects tobaccos into paper tube automatically.

Another object of the present invention of is to provide a cigarette injector which injects tobaccos into paper tube fast and conveniently.

Another object of the present invention of is to provide a cigarette injector does not break the tobaccos during injecting.

Another object of the present invention of is to provide a cigarette injector which is adapted to inject different kinds of tobaccos.

Another object of the present invention of is to provide a cigarette injector which is able to adjust the compactness of the tobaccos injected into the paper tube.

Accordingly, in order to accomplish the above objects, the present invention provides a cigarette injector for injecting tobacco leaves into a hollow cigarette paper tube, comprising:

a housing having a tobacco cavity for the tobacco leaves disposing thereat;

an electric motor, having an output shaft, received in the housing; and a cigarette filling arrangement, which comprises:

an elongated injection tube having a supplying end extended from the housing to communicate with the tobacco cavity and an opposed dispensing end for the cigarette paper tube encircling therewith; and an elongated tobacco feeder, which has a helicoid shape, having a driving end being driven to rotate via the output shaft of the electric motor and a feeding end extended within the injection tube through the tobacco cavity, wherein the tobacco feeder is driven to rotate for loading the tobacco leaves within the tobacco cavity into the cigarette paper tube through the injection tube.

These and other objectives, features, and advantages of the present invention will become apparent from the following detailed description, the accompanying drawings, and the appended claims.

DETAILED DESCRIPTION OF THE PREFERRED EMBODIMENT

Figure 1:
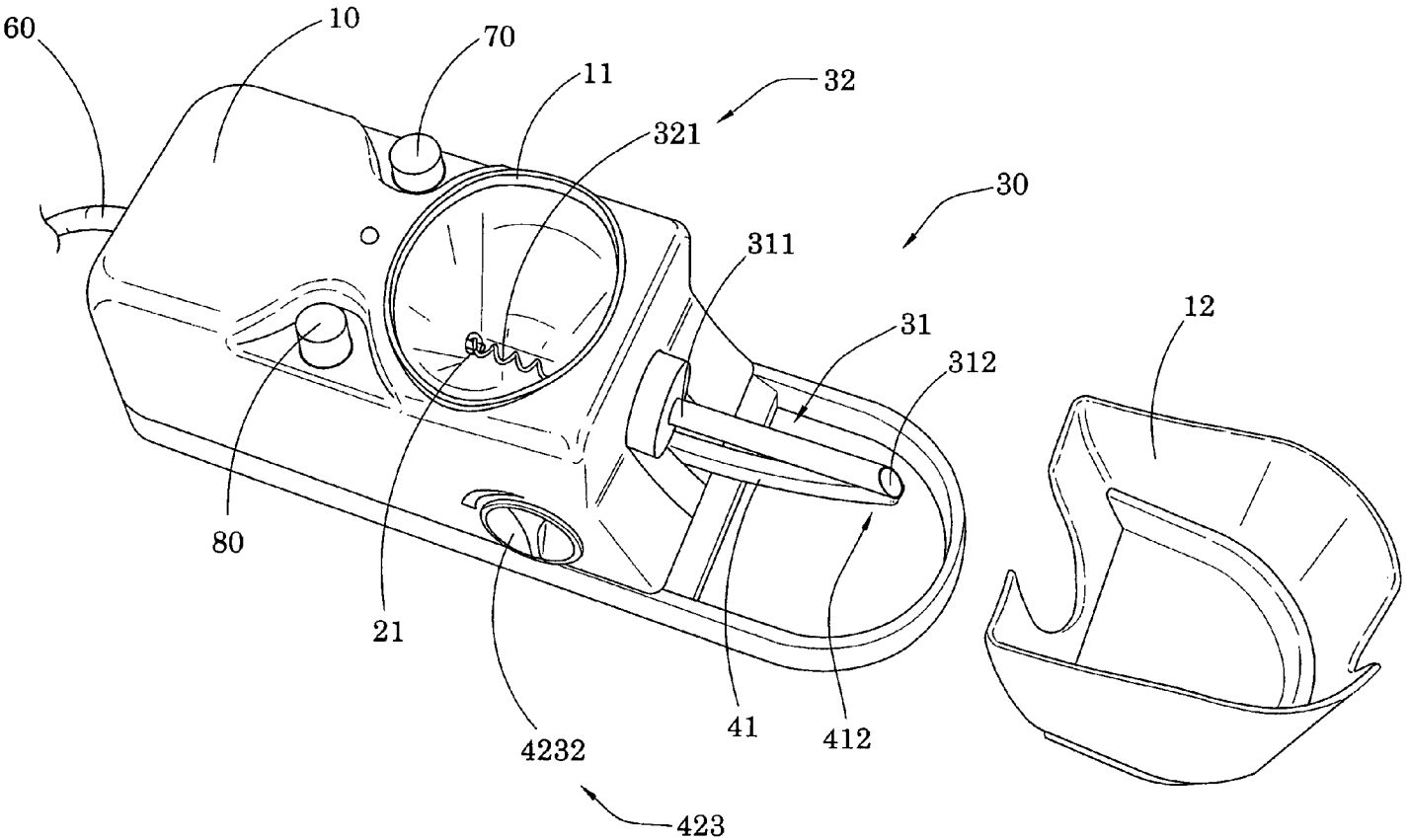
FIG. 1 is a perspective view of the cigarette injector according to a preferred embodiment of the present invention.
Figure 2:
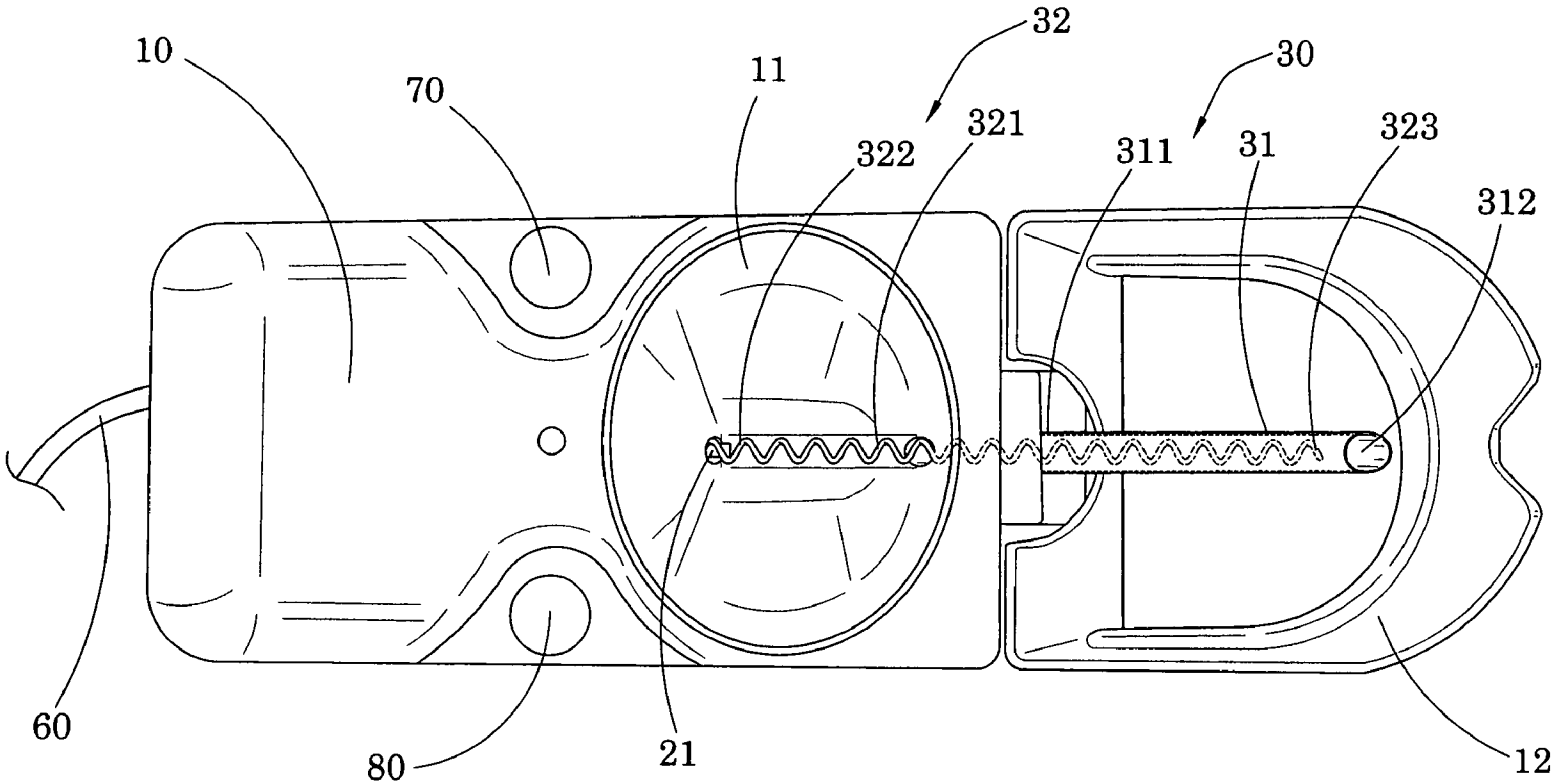
FIG. 2 is a top view of the cigarette injector according to the above preferred embodiment of the present invention.

Referring to FIGS. 1 to 4 of the drawings, a cigarette injector according to a preferred embodiment of the present invention is illustrated, wherein the cigarette injector, which is adapted for loading tobacco leaves 90 in a hollow cigarette paper tube 50, comprises a housing 10, an electric motor 20 receiving in the housing 10, and a cigarette filling arrangement 30.

The housing 10 has a tobacco cavity 11 to receive tobacco leaves 90 therein. In a preferred embodiment of the present invention, the tobacco cavity 11 is in a funnel shape. At the top of the tobacco cavity 11 is a top enlarged loading opening formed at the top ceiling of the housing 10, wherein the loading opening of the tobacco cavity 11 has a larger area for disposing the tobacco leaves 90. At the bottom the tobacco cavity 11 has a bottom narrowed supplying opening communicating with the cigarette filling arrangement 30. Accordingly, the supplying opening of the tobacco cavity 11 has a smaller area than the loading opening and is aligned with the cigarette filling arrangement 30. The tobacco cavity 11 further has a slanted circumferential wall extended from the top enlarged loading opening to the bottom narrowed supplying opening for ensuring the tobacco leaves 90 being loaded into the cigarette filling arrangement 30. In other words, the tobacco leaves 90 are disposed at the bottom of the tobacco cavity 11 and are fed to the cigarette filling arrangement 30.

The electric motor 20 comprises an output shaft 21 extended from the axle thereof for generating a rotational power, and is mechanically connected with the cigarette filling arrangement 30.

The cigarette filling arrangement 30 further comprises an elongated injection tube 31, and an elongated tobacco feeder 32. The outer diameter of the injection tube 31 is slightly smaller than the inner diameter of the hollow cigarette paper tube 50, so the injection tube 31 can be encircled by the hollow cigarette paper tube 50. The injection tube 31 has a supplying end 311 and a dispensing end 312, wherein the cigarette paper tube 50 is retained at the dispensing end 312 of the injection tube 31 in position. The supplying end 311 of the injection tube 31 is held by the housing 10 to communicate with the supplying end of the tobacco cavity 11. The opening of the supplying end 311 of the injection tube 31 is facing and exposed to the tobacco cavity 11 so the injection tube 31 is communicatively connected with the tobacco cavity 11 at the bottom thereof. In this way the tobacco leaves 90 disposed at the supplying end of the tobacco cavity 11 can be transferred into the injection tube 31 through the opening of the supplying end 311 of the injection tube 31. The rest of the injection tube 31 as well as the dispensing end 312 are extended from the housing 10 where the supplying end 311 is held, and is suspended out of the housing 10. The length of the suspended portion of the injection tube 31 is longer than the paper tube 50, so that a whole hollow cigarette paper tube 50 can sleeve over the injection tube 31. It is worth mentioning the hollow cigarette paper tube 50 can be prepared by users of can be purchased on market. One end of the paper tube 50 is opened, and another end of the paper tube 50 is closed, usually by a cigarette filter. The dispensing end 312 of the injection tube 31 has a wedged opening or sharp end so the paper tube 50 can be easily sleeved over the injection tube 31 through the dispensing end 312. Once the paper tube 50 is totally encircling over the injection tube 31, the tobacco leaves 90 can be injected through the dispensing end 312 of the injection tube 31 into the paper tube 50.

The tobacco feeder 32 has an elongated structure formed in helicoid shape. In a preferred embodiment, the tobacco feeder 32 comprises an elongated wire 321 twisted in a helicoid form, like a spring, referring to FIG. 1. The tobacco feeder 32 further has a driving end 322 and an opposed feeding end 323.

The elongated wire 321 has a uniform diameter extended from the driving end 322 to the feeding end 323, wherein the uniform diameter of the elongated wire 321 is smaller than the inner diameter of the injection tube 31 such that the feeding end 323 of the elongated wire 321 is coaxially supported within the injection tube 31 so as to permit the elongated wire 321 being freely rotated within the injection tube 31 for feeding the tobacco leaves into the cigarette paper tube 50 through the injection tube 31.

The driving end 322 of the tobacco feeder 32 is driven by the electric motor 20 for rotating. In a preferred embodiment, the output shaft 21 of the electric motor 20 and the elongated wire 321 of the tobacco feeder 32 are coaxially coupled along the axle of the electric motor 20 at the driving end 322. The feeding end 323 of the tobacco feeder 32 extends from the driving end 322 thereof longitudinally and is suspended. It is worth mentioning, the direction of the rotation of the electric motor 20 is cooperated with the twist orientation of the elongated wire 321 in such a manner that the tobacco leaves 90 are pushing towards the feeding end 323 of the tobacco feeder 32. For example, facing the feeding end 323 of the elongated wire 321, if the elongated wire 321 is twisted in right hand direction, the electric motor 20 will rotate in clockwise.

As shown in FIGS. 2 to 5, the elongated wire 321 is twisted by a wire which has a circular cross section. In this way, the surface of the elongated wire 321 is obtuse. There is no sharp edge or blade along it. This obtuse surface will not shred or break the tobacco leaves 90 during injecting. The diameter of the elongated wire 321 in helicoid form is smaller than the inner diameter of the injection tube 31. It is worth mentioning that the feeding end 323 of the tobacco feeder 32 is coaxially supported within the injection tube 31 for evenly loading the tobacco leaves 90 into the cigarette paper tube 50 through the injection tube 31.

The output shaft 21 of the electric motor 20 and the injection tube 31 are aligned coaxially at the opposite sides of the bottom of the tobacco cavity 11 respectively. Accordingly, the driving end 322 of the tobacco feeder 32 is coupled with the output shaft 21 of the electric motor 20 while the feeding end 323 of the tobacco feeder 32 is extended towards the dispensing end 312 of the injection tube 31 through the tobacco cavity 11. The output shaft 21 of the electric motor 20 is facing the supplying end 311 of the injection tube 31. The feeding end 323 of the tobacco feeder 32 extends into the injection tube 31 and suspends therein until the wedge opening of the dispensing end 312 thereof. In this manner, a portion of the elongated wire 321 next to the driving end 322 is suspended at the bottom of the tobacco cavity 11, and another portion of the elongated wire 321 next to the feeding end 323 is suspended inside the injection tube 31.

Figure 6:
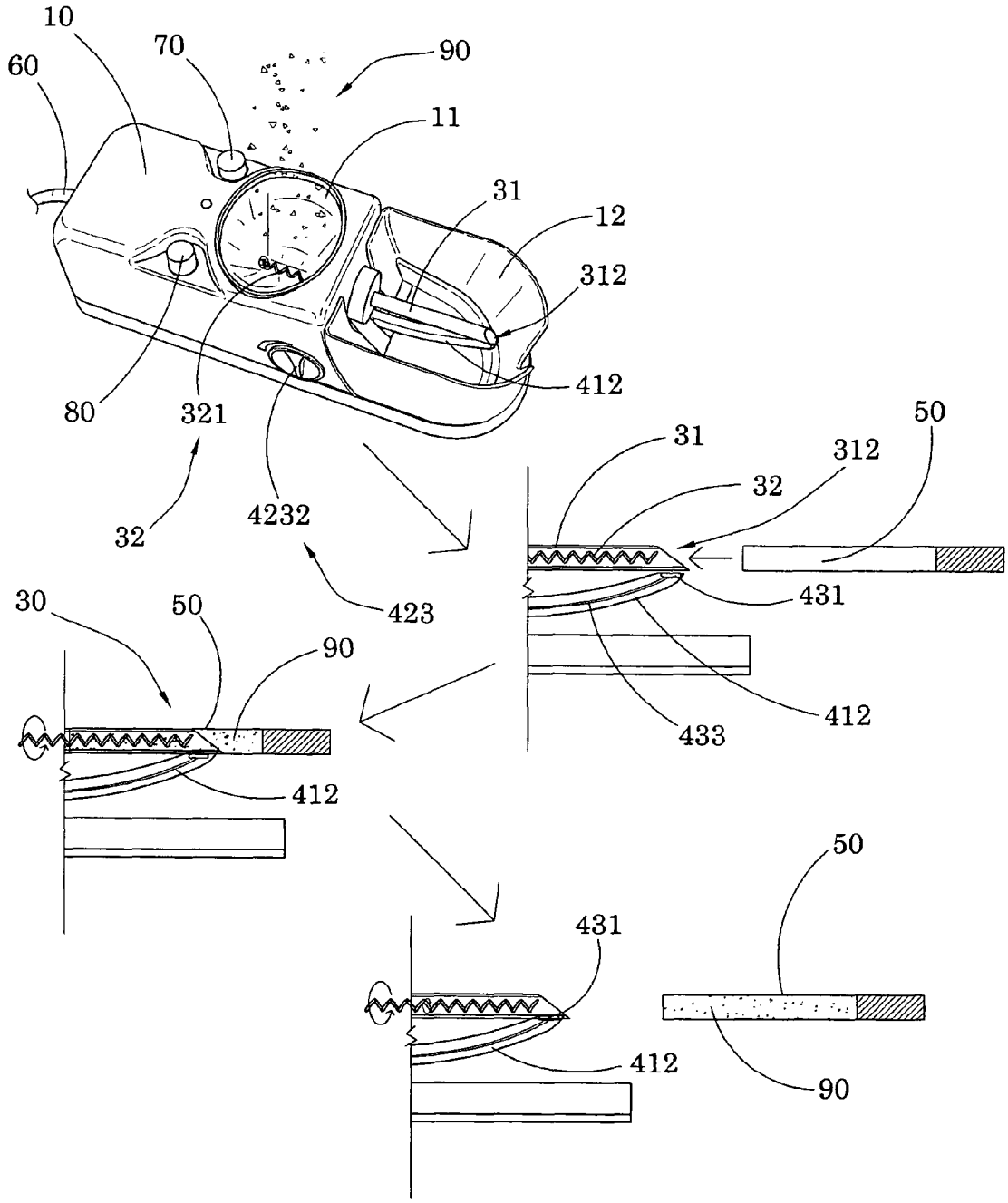
FIG. 6 is a schematic view of the cigarette injector according to the above preferred embodiment of the present invention, illustrating the cigarette injecting procedure.

Referring to FIG. 6, during tobacco injection, the user sleeves the injection tube 31 by a hollow cigarette paper tube 50 to the end. Then the user load tobacco leaves 90 into the tobacco cavity 11. When the user turns on the electric motor 20, the output shaft 21 of the electric motor 20 drives the elongated wire 321 to rotate. The rotating elongated wire 321 then pushes the tobacco leave disposed at the bottom of the tobacco cavity 11 into the injection tube 31, and further into the paper tube 50 through the dispensing end 312 of the injection tube 31.

Figure 5:
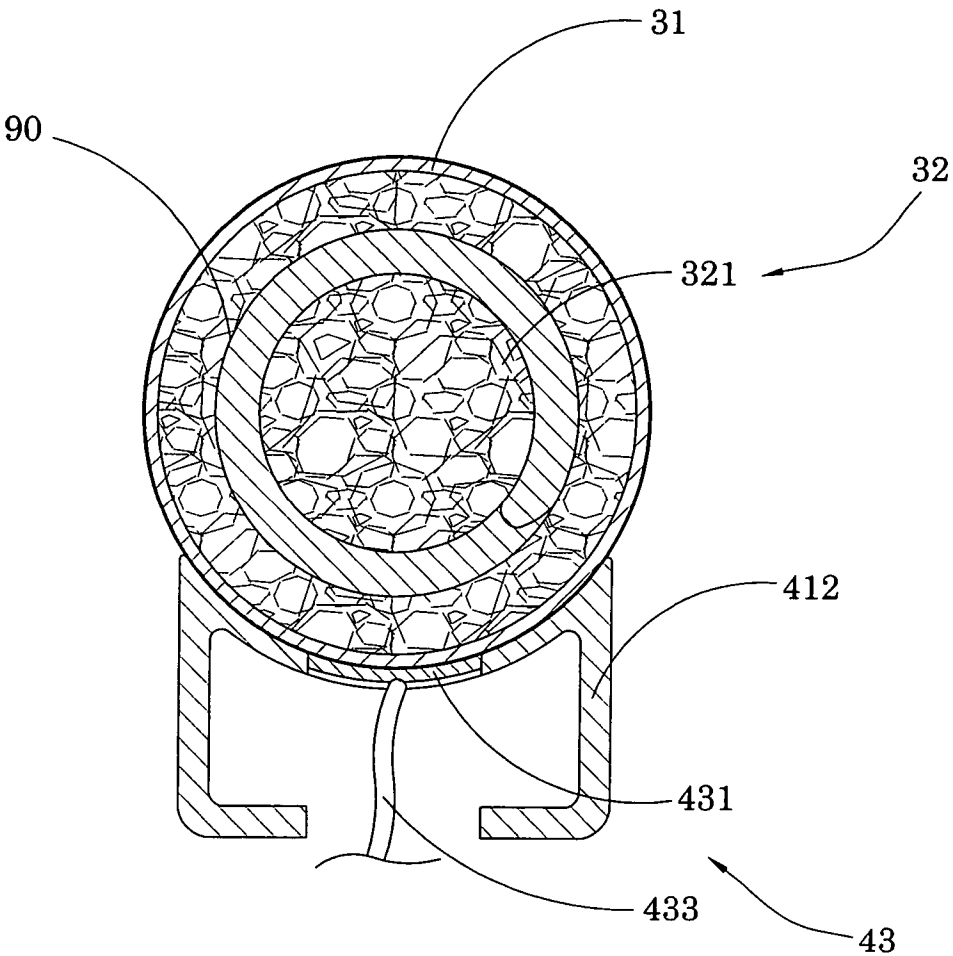
FIG. 5 is a front view of the cigarette feeding arrangement of the cigarette injector according to the above preferred embodiment of the present invention.

Referring to FIG. 5, the diameter of the tobacco feeder 32 is smaller than the inner diameter of the injection tube 31, so there is a gap between the inner wall of the injection tube 31 and the elongated wire 321. The gap prevents the tobacco leaves 90 from being crushed and shredded.

Figure 3:
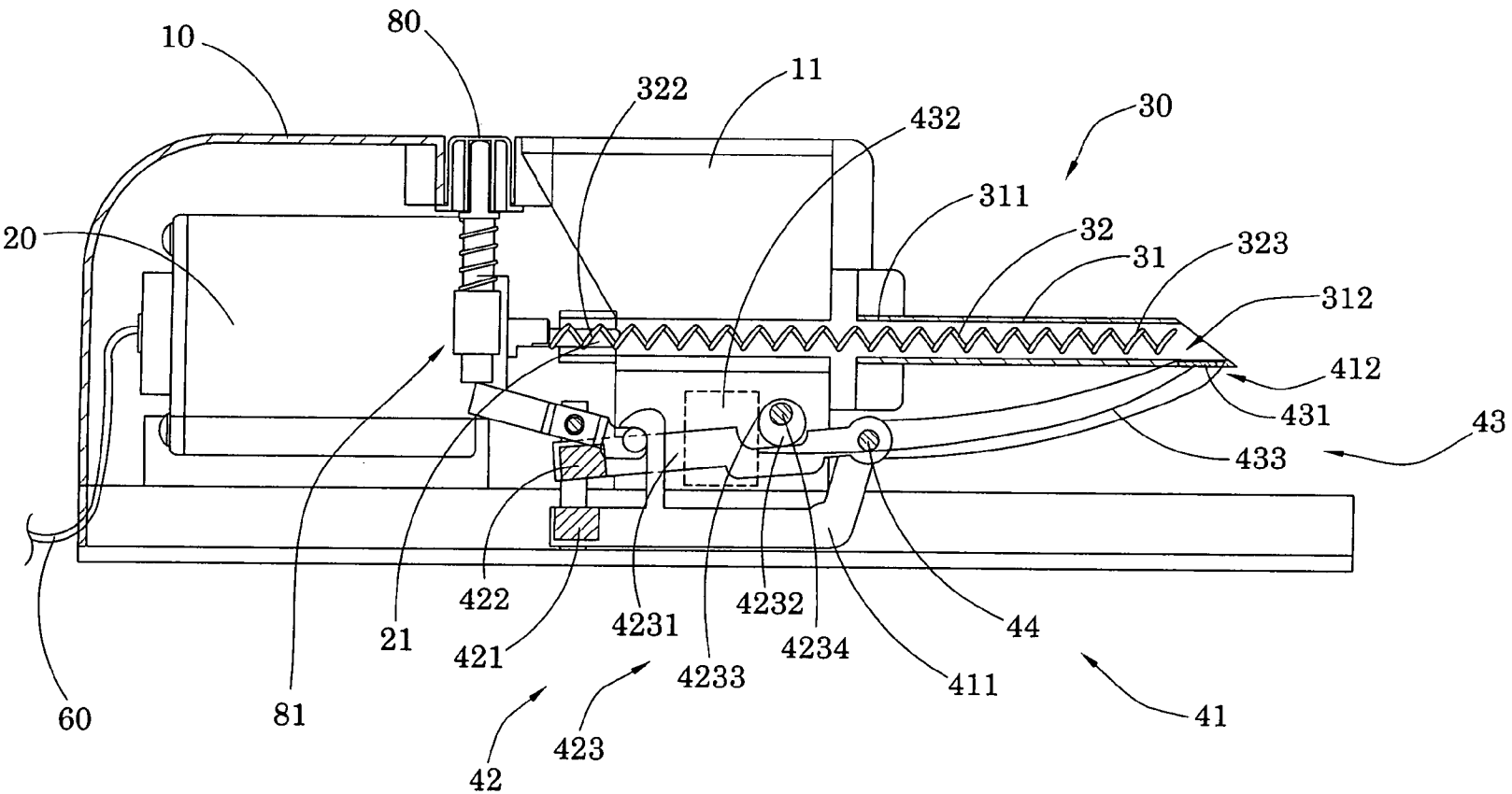
FIG. 3 is a sectional view of the cigarette injector according to the above preferred embodiment of the present invention, illustrating the meter device being adjusted to shorten the distance between two magnetic elements.
Figure 4:
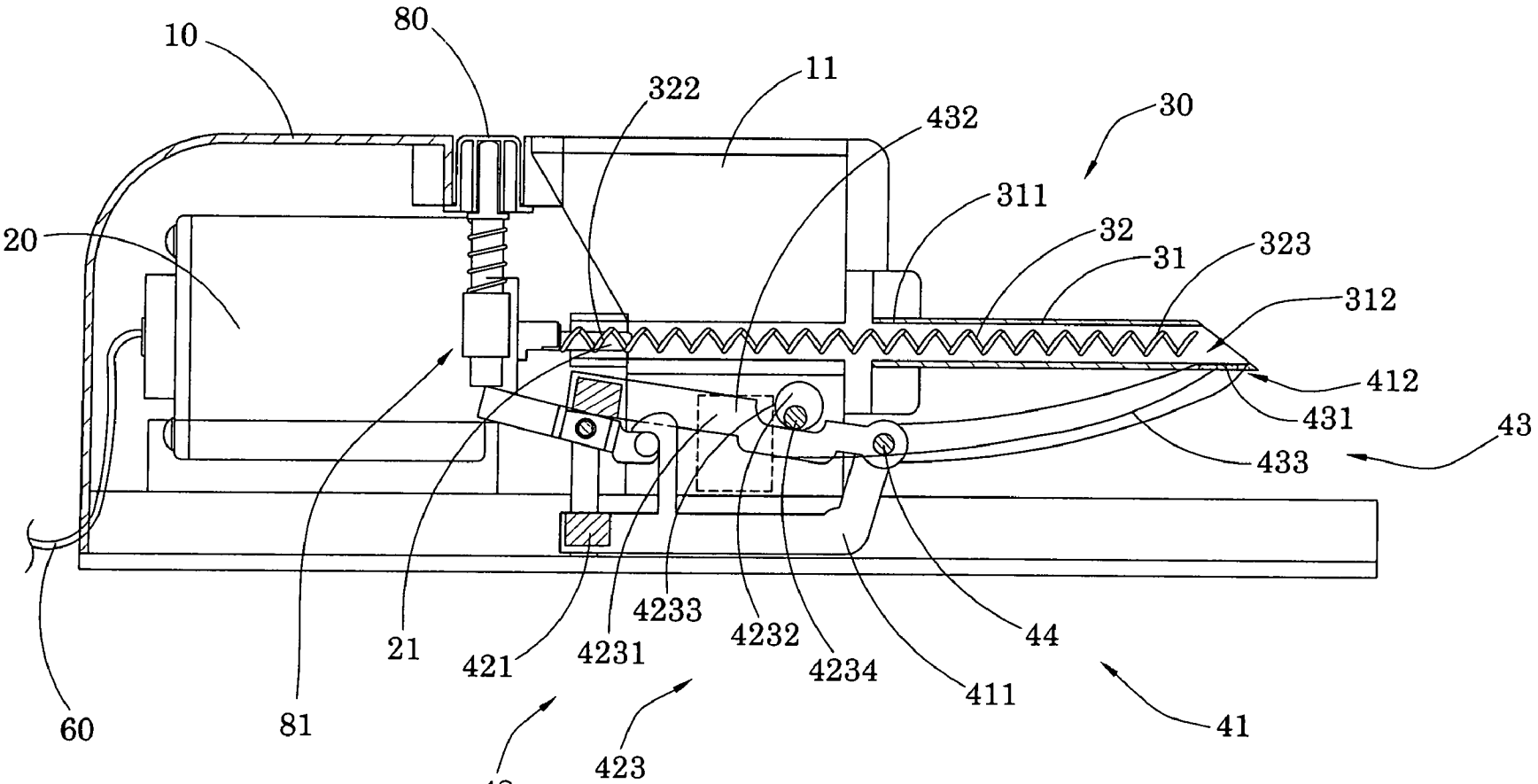
FIG. 4 is a sectional view of the cigarette injector according to the above preferred embodiment of the present invention, illustrating the meter device being adjusted to lengthen the distance between two magnetic elements.

Referring to FIGS. 3 and 4, the cigarette injector further comprises a meter device 40 for gauging compactness of the tobacco leaves 90 into the cigarette paper tube 50. The meter device 40 comprises a retention arm 41, which is supported by a pivot 44 provided by the housing 10 which is beneath the injection tube 31. The retention arm 41 can pivotally move around the pivot 44. The retention arm 41 has a levering end 411 and a retention end 412. The retention end 412 of the retention arm 41 extends from the pivot 44 to the injection tube 31 and contacts with the injection tube 31 under the dispensing end 312 thereof. The levering end 411 of the retention arm 41 extends from the pivot 44 against the retention end 412. Like a lever, when the levering end 411 is pivotally pushed down, the retention end 412 is pivotally lifted up such that the retention end 412 of the retention arm 41 provides a clipping force towards the dispensing end 312 of the injection tube 31. When a paper tube 50 is sleeved over the injection tube 31, this clipping force will hold the paper tube 50 from being pushed away by the injected tobacco leaves 90 driven by the tobacco feeder 32. In other words, the pushing force applied through the tobacco leaves 90 must be larger than the clipping force in order to push the paper tube 50 to slide away from the injection tube 31. By this way, the tobacco leaves 90 injected into the paper tube 50 are adjustably compressed.

Referring to FIGS. 3 and 4, in a preferred embodiment of the present invention, the meter device 40 also comprises a metering control 42 supported in the housing 10 for selectively adjusting the clipping force at the retention end 412 of the retention arm 41. The metering control 42 further comprises a first magnetic element 421 coupled at the levering end 411 of the retention arm 41, a second magnetic element 422 supported within the housing 10 to spacedly align with the first magnetic element 421 for mutually producing a magnetically repelling force between the first and second magnetic elements 421, 422, and an adjustor 423 selectively adjusting a position of the second magnetic element 422 to adjust a distance between the first and second magnetic elements 421, 422 so as to adjust the magnetically repelling force therebetween.

The adjustor 423 comprises a supporting arm 4231, and an adjusting wheel 4232. One end of the supporting arm 4231 is pivotally supported by a pivot provided by the housing 10. Preferably, the pivot is the same pivot 44 supporting the retention arm 41. The other end of the supporting arm 4231 is retaining the second magnetic element 422 thereat to support the second magnetic element 422 in position. It extends from the pivot 44 towards the levering end 411 of the retention arm 41 and is above the levering end 411. The first magnetic element 421 and the second magnetic element 422 are two magnets with same pole facing towards each other and produce the magnetically repelling force mutually. This repelling force tends to push down the levering end 411 of the retention arm 41 and lift the retention end 412 of the retention arm 41 consequently to provide the clipping force between the retention end 412 of the retention arm 41 and the dispensing end 312 of the injection tube 31.

The adjusting wheel 4232 has an outer circumferential surface 4233 which contacts with the supporting arm 4231, and an eccentric axle 4234 which is supported by the housing 10. When the adjusting wheel 4232 is rotated along the eccentric axle 4234, the contact point of the outer circumferential surface 4233 with the supporting arm 4231 is rotated. Because of the eccentric axle 4234, the distance between the supporting arm 4231 and the eccentric axle 4234 is adjusted. Then the supporting arm 4231 is rotated along the pivot. As a result, the distance between the first magnetic element 421 and the second magnetic element 422 is adjusted. So the repelling force, as well as the clipping force of the retention arm 41 is adjusted. In this way the compactness of the tobacco leaves 90 injected into the paper tube 50 can be selectively adjusted. FIG. 3 illustrates a shorter distance between the first magnetic element 421 and the second magnetic element 422. FIG. 4 illustrates a longer distance between the first magnetic element 421 and the second magnetic element 422. It is worth mentioning that when the distance between the first and second magnetic elements 421, 422 is increased to reduce the mutual repelling force, the clipping force applied at the retention end 412 of the retention arm 41 will be reduced. Therefore, the tobacco leaves 90 will be loaded into the paper tube 50 with less compactness because the paper tube 50 will be pushed out of the injection tube 31 during the loading operation by lesser clipping force. Likewise, when the distance between the first and second magnetic elements 421, 422 is decreased to increase the mutual repelling force, the clipping force applied at the retention end 412 of the retention arm 41 will be increased. The tobacco leaves 90 will be loaded into the paper tube 50 with high compactness because the paper tube 50 will be pushed out of the injection tube 31 during the loading operation by greater clipping force.

The meter device 40 further comprises a loading detector 43 for detecting the tobacco leaves 90 being fully loaded into the paper tube 50. In other words, the loading detector 43 will detect whether the paper tube 50 is slidably pushed out of the injection tube 31 or not.

The loading detector 43 comprises a contacting terminal 431, and an activation circuit 432. The contract terminal 431 is provided at the retention end 412 of the retention arm 41 and is contacted with the injection tube 31 by the clipping force provided by the retention arm 41. The activation circuit 432 is electrically coupled between the contacting terminal 431 and the injection tube 31 at the dispensing end 312 thereof through a contacting wire 433. The activation circuit 432 works in such a manner that when the contacting terminal 431 is electrically separated from the injection tube 31, preferably by the cigarette paper tube 50, the activation circuit 432 permits the electric motor 20 to operate. Otherwise, when the contacting terminal 431 electrically contacts with the injection tube 31, i.e. the paper tube 50 is pushed out of the injection tube 31, the activation circuit 432 deactivates the electric motor 20 to operate.

Before tobacco injection, a hollow cigarette paper tube 50 is sleeved over the injection tube 31. So the contacting terminal 431 and the injection tube 31 are separated by the cigarette paper tube 50. But the retention end 412 of the retention arm 41, as well as the contacting terminal 431 provides the clipping force to the paper tube 50. In this situation, the activation circuit 432 allows the electric motor 20 to operate. The electric motor 20 then drives the tobacco feeder 32 to feed tobacco leaves 90 into the cigarette paper tube 50 through the injection tube 31. When the pushing force is larger than the clipping force, the tobacco leaves 90 are compressed into the paper tube 50 and further push the paper tube 50 to slide away from the injection tube 31. When the paper tube 50 is fully loaded with tobacco leaves 90, the cigarette paper tube 50 is pushed away from the contact area between the contacting terminal 431 and the injection tube 31. At this time the contracting terminal and the injection tube 31 are electrically connected by contacting. The activation circuit 432 then detects the connection and deactivates the electric motor 20 to stop injecting tobacco leaves 90.

Referring to FIGS. 1 to 4, in a preferred embodiment of the present invention, the cigarette injector also comprises a power cable 60 to electrically connected with power outlet for providing power, a start button 70 to activate the electric motor 20, and a press button 80 mechanically connected with a lever arrangement 81 that by pushing the press button 80, the retention arm 41 is pulling away by the lever arrangement 81 from the injection tube 31 to leave a gap for loading the cigarette paper tube 50. The cigarette injector also comprises a tobacco receiver 12 retained by the housing 10 under the dispensing end 312 of the injection tube 31 for receiving the leaked tobacco leaves 90 during injection. The tobacco receiver 12 can be detached from the housing 10 for disposing the received tobacco leaves 90 back to the tobacco cavity 11.

In order to operate the cigarette injector of the present invention, as shown in FIG. 6, the user is able to slidably place the cigarette paper tube 50 at the dispensing end 312 of the injection tube 31 at a position that the dispensing end 312 of the injection tube 31 is encircled by the cigarette paper tube 50. It is worth to mention that the press button 80 is pressed to pivotally move the retention end 412 of the retention arm 41 away from the dispensing end 312 of the injection tube 31 such that the cigarette paper tube 50 can be slid at the dispensing end 312 of the injection tube 31. Once the pressing force at the press button 80 is released, the retention end 412 of the retention arm 41 is pivotally moved towards the dispensing end 312 of the injection tube 31 to retain the cigarette paper tube 50 in position. In addition, the contacting terminal 431 does not contact with the injection tube 31 because the cigarette paper tube 50 separates the contact between the contacting terminal 431 and the injection tube 31.

At the same time, a predetermined amount of the tobacco leaves can be disposed in the tobacco cavity 11 of the housing 10 for preparing the loading operation thereof. Accordingly, the user is able to selectively adjust the compactness of the tobacco leaves 90 to be loaded into the cigarette paper tube 50 via the meter device 40 by adjustably rotating the adjusting wheel 4232 at the sidewall of the housing 10. Once the meter device 40 is set, the clipping force will be applied at the retention end 412 of the retention arm 41 to retain the cigarette paper tube 50 at the dispensing end 312 of the injection tube 31 in position.

Once the start button 70 is pressed to activate the electric motor 20, the tobacco feeder 32 is driven to rotate. The tobacco leaves are guided to push forward to the dispensing end 312 of the injection tube 31 through the rotational movement of the tobacco feeder 32. At the same time, the tobacco leaves are pushed to continuously load into the cigarette paper tube 50. Accordingly, once the pushing force of the tobacco leaves, i.e. the loading force, is larger than the clipping force, the cigarette paper tube 50 is pushed to gradually slide out of the dispensing end 312 of the injection tube 31. At the time when the cigarette paper tube 50 is entirely pushed out of the dispensing end 312 of the injection tube 31, the contacting terminal 431 will contact with the injection tube 31 to stop the operation of the electric motor 20. Therefore, the tobacco leaves are loaded into the cigarette paper tube 50 with a predetermined compactness.

In summary, the cigarette injector is adapted to loading different kind of tobacco leaves 90 into hollow cigarette paper tube 50. The loading can be stopped automatically when the cigarette paper tube 50 is fully loaded. The compactness of the tobacco leaves 90 loaded inside the cigarette paper tube 50 can be selectively adjusted.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A cigarette injector for injecting tobacco leaves into a hollow cigarette paper tube, comprising:

a housing having a tobacco cavity for said tobacco leaves disposing thereat;

an electric motor, having an output shaft, received in said housing; and a cigarette filling arrangement, which comprises:

an elongated injection tube having a supplying end extended from said housing to communicate with said tobacco cavity and an opposed dispensing end for said cigarette paper tube encircling therewith to retain said cigarette paper tube at a position that said cigarette paper tube is coaxially aligned with said injection tube;

an elongated tobacco feeder which comprises an elongated wire, which is twisted in a helicoid form and is formed with a uniform diameter, having a driving end being driven to rotate via said output shaft of said electric motor and a feeding end extended within said injection tube through said tobacco cavity, wherein said elongated wire has a circular cross section to provide an obtuse outer surface for preventing said tobacco leaves being shredded when said tobacco feeder is rotated, wherein said tobacco feeder is driven to rotate for loading said tobacco leaves within said tobacco cavity into said cigarette paper tube through said injection tube; and a meter device for gauging compactness of said tobacco leaves into said cigarette paper tube, wherein meter device comprises a retention arm, which is pivotally supported at said housing, having a levering end and a retention end extended to contact with said dispensing end of said injection tube for applying a clipping force thereat so as to hold said cigarette paper tube at said dispensing end of said injection tube, and a metering control supported in said housing for selectively adjusting said clipping force at said retention end of said retention arm; wherein said metering control comprises a first magnetic element coupled at said levering end of said retention arm, a second magnetic element supported within said housing to spacedly align with said first magnetic element for mutually producing a magnetically repelling force between said first and second magnetic elements, and an adjuster selectively adjusting a position of said second magnetic element to adjust a distance between said first and second magnetic elements so as to adjust said magnetically repelling force therebetween.

2. The cigarette injector, as recited in claim 1, wherein said adjuster comprises a supporting arm pivotally supported in said housing to retain said second magnetic element in position and an adjusting wheel having an eccentric axle coupled with said housing and an outer circumferential surface contacting with said supporting arm in such a manner that when said adjusting wheel is eccentrically rotated, said supporting arm is driven to move adjust a position of said second magnetic element so as to adjust said distance between said first and second magnetic elements.

3. The cigarette injector, as recited in claim 2, wherein said tobacco feeder has a uniform diameter smaller than a diameter of said injection tube, wherein said feeding end of said tobacco feeder is coaxially supported within said injection tube for evenly loading said tobacco leaves into said cigarette paper tube through said injection tube.

4. The cigarette injector, as recited in claim 2, wherein said injection tube is coaxially aligned with said output shaft of said electric motor that said driving end of said tobacco feeder is coupled with said output shaft while said feeding end of said tobacco feeder is extended towards said dispensing end of said injection tube through said tobacco cavity.

5. The cigarette injector, as recited in claim 2, wherein said meter device further comprises a loading detector for detecting said tobacco leaves being fully loaded into said cigarette paper tube, wherein said loading detector comprises a contacting terminal provided at said retention end of said retention arm and an activation circuit electrically coupling between said contacting terminal with said injection tube in such a manner that when said contacting terminal is separated from said injection tube via said cigarette paper tube, said activation circuit permits an operation of said electric motor, and when said contacting terminal contacts with said injection tube at the time said cigarette paper tube is fully loaded with said tobacco leaves and is slidably pulled out of said retention end of said retention arm, said activation circuit automatically deactivates said electric motor from being operated.

6. The cigarette injector, as recited in claim 5, wherein said tobacco cavity, having a funnel shape, has a top enlarged loading opening formed on top of said housing, a bottom narrowed supplying opening communicating with said supplying end of said injection tube, and a slanted circumferential wall extended from said top enlarged loading opening to said bottom narrowed supplying opening for ensuring said tobacco leaves being loaded into said injection tube via said tobacco feeder.

7. The cigarette injector, as recited in claim 5, wherein said tobacco feeder has a uniform diameter smaller than a diameter of said injection tube, wherein said feeding end of said tobacco feeder is coaxially supported within said injection tube for evenly loading said tobacco leaves into said cigarette paper tube through said injection tube.

8. The cigarette injector, as recited in claim 7, wherein said injection tube is coaxially aligned with said output shaft of said electric motor that said driving end of said tobacco feeder is coupled with said output shaft while said feeding end of said tobacco feeder is extended towards said dispensing end of said injection tube through said tobacco cavity.

9. The cigarette injector, as recited in claim 8, wherein said tobacco cavity, having a funnel shape, has a top enlarged loading opening formed on top of said housing, a bottom narrowed supplying opening communicating with said supplying end of said injection tube, and a slanted circumferential wall extended from said top enlarged loading opening to said bottom narrowed supplying opening for ensuring said tobacco leaves being loaded into said injection tube via said tobacco feeder.

10. The cigarette injector, as recited in claim 9, wherein said injection tube, having a diameter slightly smaller than a diameter of said cigarette paper tube, has a sharp end formed at said retention end for slidably inserting into said cigarette paper tube.

11. The cigarette injector, as recited in claim 1, wherein said meter device further comprises a loading detector for detecting said tobacco leaves being fully loaded into said cigarette paper tube, wherein said loading detector comprises a contacting terminal provided at said retention end of said retention arm and an activation circuit electrically coupling between said contacting terminal with said injection tube in such a manner that when said contacting terminal is separated from said injection tube via said cigarette paper tube, said activation circuit permits an operation of said electric motor, and when said contacting terminal contacts with said injection tube at the time said cigarette paper tube is fully loaded with said tobacco leaves and is slidably pulled out of said retention end of said retention arm, said activation circuit automatically deactivates said electric motor from being operated.

* * * * *